US010490950B2

(12) United States Patent
Minnick et al.

(10) Patent No.: US 10,490,950 B2
(45) Date of Patent: Nov. 26, 2019

(54) HEADER CONNECTOR HAVING HEADER GROUND SHIELDS

(71) Applicant: TE CONNECTIVITY CORPORATION, Berwyn, PA (US)

(72) Inventors: Timothy Robert Minnick, Enola, PA (US); Xingling Zhou, Hummelstown, PA (US); Justin Dennis Pickel, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/700,292

(22) Filed: Sep. 11, 2017

(65) Prior Publication Data

US 2019/0081441 A1 Mar. 14, 2019

(51) Int. Cl.

| | |
|---|---|
| ***H01R 13/6594*** | (2011.01) |
| ***H01R 13/6588*** | (2011.01) |
| ***H01R 12/71*** | (2011.01) |
| ***H01R 13/6585*** | (2011.01) |
| *H01R 13/6587* | (2011.01) |
| *H01R 13/648* | (2006.01) |
| *H01R 13/6581* | (2011.01) |

(52) U.S. Cl.

CPC ..... *H01R 13/6588* (2013.01); *H01R 12/716* (2013.01); *H01R 13/6585* (2013.01); *H01R 13/6594* (2013.01); *H01R 13/648* (2013.01); *H01R 13/6581* (2013.01); *H01R 13/6587* (2013.01)

(58) Field of Classification Search

CPC ..... H01R 13/648; H01R 13/6581; H01R 13/6594; H01R 13/6587

USPC ..... 439/607.01, 607.07, 607.09, 607.08

See application file for complete search history.

(56) References Cited

U.S. PATENT DOCUMENTS

| | | | |
|---|---|---|---|
| 6,347,962 B1 | 2/2002 | Kline | |
| 6,471,549 B1 | 10/2002 | Lappohn | |
| 6,899,566 B2 | 5/2005 | Kline et al. | |
| 6,913,490 B2 | 7/2005 | Whiteman, Jr. et al. | |
| 7,485,001 B2 | 2/2009 | Chen et al. | |
| 8,430,691 B2 | 4/2013 | Davis | |
| 2016/0172792 A1* | 6/2016 | Horning | H01R 13/6594 439/607.07 |

* cited by examiner

*Primary Examiner* — Abdullah A Riyami
*Assistant Examiner* — Justin M Kratt

(57) ABSTRACT

A header connector includes header ground shields each having a main panel, a first side panel extending from a first side of the main panel and a second side panel extending from a second side of the main panel. The main panel, the first side panel and the second side panel define a shield pocket receiving and shielding a signal contact. The first side panel includes a first overlapping segment and a first engagement segment and the second side panel includes a second overlapping segment and a second engagement segment. The header ground shields are arranged in shield columns and corresponding header ground shields in the same shield column engage adjacent header ground shields such that the first overlapping segments overlap second engagement segments of the adjacent header ground shield and such that the second overlapping segments overlap first engagement segments of the adjacent header ground shield.

23 Claims, 5 Drawing Sheets

HEADER CONNECTOR HAVING HEADER GROUND SHIELDS

BACKGROUND OF THE INVENTION

The subject matter herein relates generally to a header connector having header ground shields.

Some electrical connector systems utilize receptacle and header connectors to interconnect two circuit boards, such as a motherboard and daughtercard. The connectors can have header ground shields that are designed to shield signal contacts from other signal contacts within the connectors. In conventional header connectors, the header ground shields are C-shaped header ground shields. The header ground shields are received in the housing of the header connector such that each of the header ground shields is separate from each other. The header ground shields are each electrically commoned through the circuit board. During a mating operation, the header ground shields of the header connector engage the header ground shields of the receptacle connector, which may electrically common the header ground shields through the receptacle connector. When the connectors are mated, the signal contacts of the header connector engage the signal contacts of the receptacle connector and the header ground shields provide electrical shielding for the signal contacts.

However, conventional electrical connector systems are not without their disadvantages. For instance, as speed and density through the electrical connector system increases, electrical performance is reduced. For example, conventional connectors have problems with noise and cross-talk. One particular area of problem with noise and cross-talk is in the header connectors. For instance, because the header ground shields are electrically commoned at spaced apart locations, such as at the circuit board and at the receptacle connector, the electrical performance through the header connector is diminished.

A need remains for a header connector having enhanced header ground shielding that improves electrical performance.

BRIEF DESCRIPTION OF THE INVENTION

In one embodiment, a header connector is provided including a housing including a base having a front side and an opposite rear side, signal contacts held in the base each having a mating segment extending forward of the front side of the base, and header ground shields held in the base and extending forward of the front side of the base. Each header ground shield has a main panel, a first side panel extending from a first side of the main panel and a second side panel extending from a second side of the main panel. The main panel, the first side panel and the second side panel define a shield pocket receiving at least one corresponding signal contact to provide electrical shielding for the corresponding signal contact(s). The first side panel includes a first overlapping segment and a first engagement segment and the second side panel includes a second overlapping segment and a second engagement segment. The header ground shields are received in the base in shield columns and corresponding header ground shields in the same shield column engage adjacent header ground shields such that the first overlapping segments overlap second engagement segments of the adjacent header ground shield and such that the second overlapping segments overlap first engagement segments of the adjacent header ground shield.

In another embodiment, a header connector is provided including a housing including a base having a front side and an opposite rear side, signal contacts held in the base each having a mating segment extending forward of the front side of the base, and header ground shields held in the base and extending forward of the front side of the base. Each header ground shield has a main panel, a first side panel extending from a first side of the main panel and a second side panel extending from a second side of the main panel. The main panel, the first side panel and the second side panel define a shield pocket receiving at least one corresponding signal contact to provide electrical shielding for the corresponding signal contact(s). The first side panel includes a first overlapping segment configured to engage an adjacent header ground shield and a first engagement segment configured to engage an adjacent header ground shield. The second side panel includes a second overlapping segment configured to engage an adjacent header ground shield and a second engagement segment configured to engage an adjacent header ground shield. At least one of the first overlapping segment and the first engagement segment includes a first mating beam extending therefrom configured to engage the adjacent header ground shield. At least one of the second overlapping segment and the second engagement segment includes a second mating beam extending therefrom configured to engage the adjacent header ground shield.

In a further embodiment, a header connector is provided including a housing including a base having a front side and an opposite rear side, signal contacts held in the base each having a mating segment extending forward of the front side of the base, and header ground shields held in the base in shield columns with the header ground shields in each column engaging each other to provide a continuous electrical shield in the shield column. The header ground shields extend forward of the front side of the base to provide electrical shielding for the mating segments of the corresponding signal contacts. The shield column includes a first header ground shield, a second header ground shield and a third header ground shield with the second header ground shield arranged between the first and third header ground shields. The first header ground shield includes a main panel, a first side panel extending from a first side of the main panel and a second side panel extending from a second side of the main panel. The main panel, the first side panel and the second side panel define a shield pocket receiving at least one corresponding signal contact to provide electrical shielding for the corresponding signal contact(s). The first side panel includes a first overlapping segment and a first engagement segment and the second side panel includes a second overlapping segment and a second engagement segment. The second header ground shield includes a main panel, a first side panel extending from a first side of the main panel and a second side panel extending from a second side of the main panel. The main panel, the first side panel and the second side panel define a shield pocket receiving at least one corresponding signal contact to provide electrical shielding for the corresponding signal contact(s). The first side panel includes a first overlapping segment and a first engagement segment and the second side panel includes a second overlapping segment and a second engagement segment. The third header ground shield includes a main panel, a first side panel extending from a first side of the main panel and a second side panel extending from a second side of the main panel. The main panel, the first side panel and the second side panel define a shield pocket receiving at least one corresponding signal contact to provide electrical shielding for the corresponding signal contact(s). The first side panel includes a first overlapping segment and a first engagement segment and the second side panel includes a second overlapping segment and a second engagement segment. The first overlapping segment of the second header ground shield overlaps and engages the second engagement segment of the first header ground shield and the second overlapping segment of the first header ground shield overlaps and engages the first engagement segment of the second header ground shield. The second overlapping segment of the second header ground shield overlaps and engages the first engagement segment of the third header ground shield and the first overlapping segment of the third header ground shield overlaps and engages the second engagement segment of the second header ground shield.

DETAILED DESCRIPTION OF THE INVENTION

Figure 1:
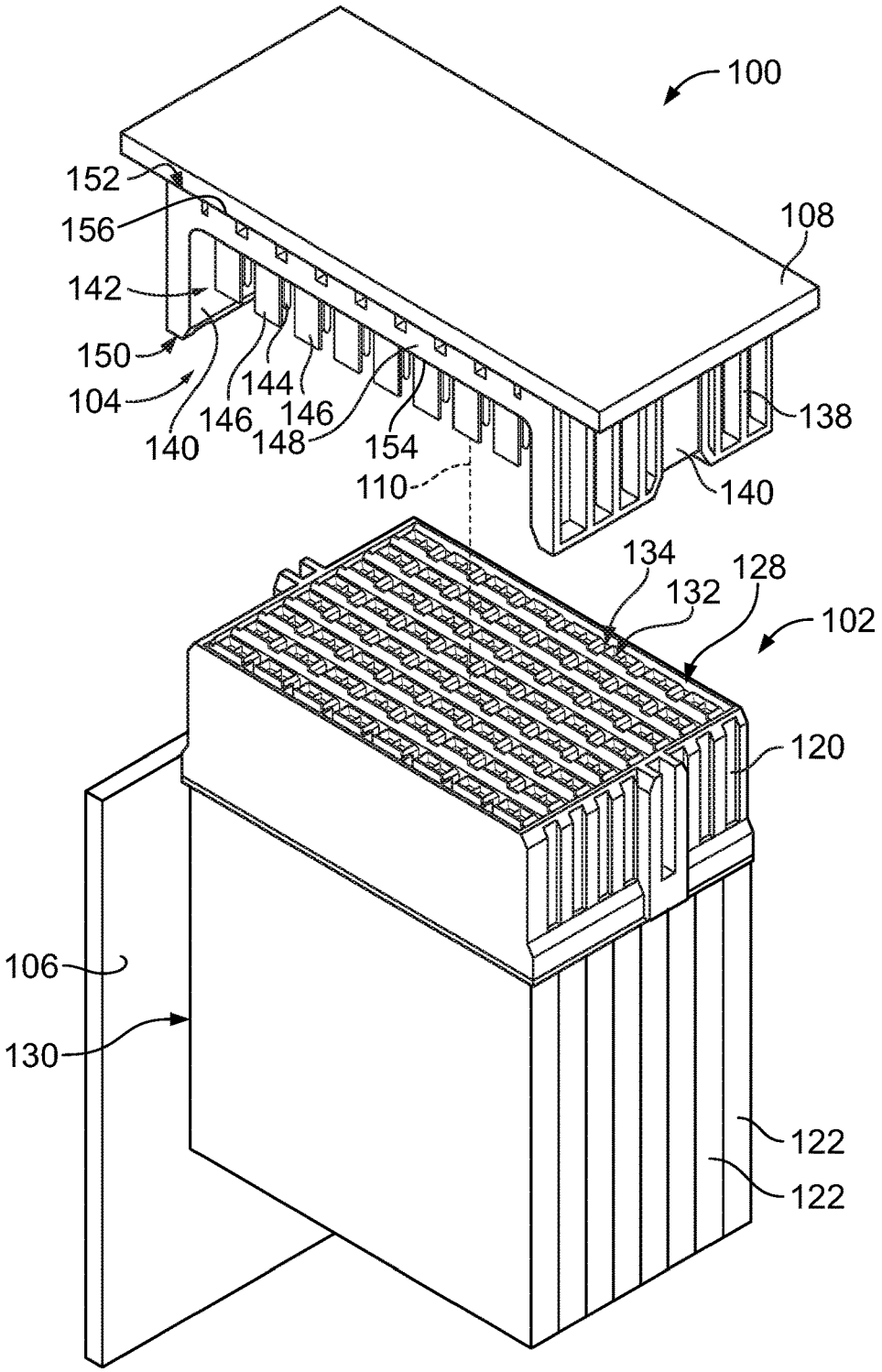
FIG. 1 is a perspective view of a connector assembly illustrating a receptacle connector and a header connector according to an embodiment.

FIG. 1 is a perspective view of a connector assembly 100 illustrating a receptacle connector 102 and a header connector 104 poised for mating according to an embodiment. The receptacle and header connectors 102, 104 may be directly mated together along a mating axis 110 to provide a conductive signal transmission path across the connectors 102, 104. The receptacle connector 102 is mounted to and electrically connected to a first circuit board 106, and the header connector 104 is mounted to and electrically connected to a second circuit board 108. The receptacle and header connectors 102, 104 are utilized to electrically connect the circuit boards 106, 108 to one another at a separable mating interface. In an exemplary embodiment, the circuit boards 106, 108 are oriented perpendicular to one another in an orthogonal mating arrangement. However, other orientations are possible in alternative embodiments, such as a mezzanine arrangement where the circuit boards 106, 108 are parallel to each other.

The receptacle connector 102 includes a receptacle housing 120 that holds a plurality of contact modules 122 in a stacked arrangement. The contact modules 122 have receptacle signal contacts 124 (shown in FIG. 8). The receptacle signal contacts 124 are electrically shielded by receptacle ground contacts 126 (shown in FIG. 8). The receptacle connector 102 extends between a mating end 128 and a mounting end 130. In the illustrated embodiment, the mounting end 130 is oriented perpendicular to the mating end 128; however, other orientations are possible in alternative embodiments. The receptacle housing 120 includes a plurality of signal openings 132 and a plurality of ground slots 134 at the mating end 128. The receptacle signal contacts 124 are disposed in the corresponding signal openings 132, and the receptacle ground contacts 126 are disposed in the ground slots 134. The signal openings 132 receive corresponding header signal contacts 144 therein when the receptacle and header connectors 102, 104 are mated to allow the header signal contacts 144 to mate with the receptacle signal contacts 124. The ground slots 134 receive header ground shields 146 therein when the receptacle and header connectors 102, 104 are mated to allow the header ground shields 146 to mate with the receptacle ground contacts 126.

The receptacle housing 120 may be manufactured from a dielectric material, such as a plastic material, that provides electrical insulation between the signal contact openings 132 and the ground slots 134. Therefore, the receptacle housing 120 may electrically insulate the receptacle signal contacts 124 and the header signal contacts 144 in the signal openings 132 from the receptacle ground contacts 126 and the header ground shields 146 in the ground slots 134.

The header connector 104 includes a header housing 138 extending between a mating end 150 and an opposite mounting end 152 that is mounted to the second circuit board 108. The header housing 138 includes a base wall or housing base 148, referred to herein as a base 148, that has a front side 154 and an opposite rear side 156. As used herein, relative or spatial terms such as "front," "rear," "top," "bottom," "first," and "second," are only used to distinguish the referenced elements and do not necessarily require particular positions or orientations relative to the surrounding environment of the header connector 104 or the connector assembly 100. The rear side 156 faces the circuit board 108 and may define the mounting end 152 of the header housing 138. The header signal contacts 144 and the header ground shields 146 are received in the base 148 and held in place by the base 148. The signal contacts 144 and the header ground shields 146 extend from the front side 154 of the base 148 to be received in the respective signal openings 132 and ground slots 134 of the receptacle housing 120 when the connectors 102, 104 are mated. Although not shown in FIG. 1, the header signal contacts 144 and the header ground shields 146 protrude from the rear side 156 of the base 148 and terminate to the circuit board 108. For example, compliant pins, such as eye-of-the-needle pins, solder tails or spring beams may be provided at the mounting end 152 for termination to the circuit board 108.

In the illustrated embodiment, the header housing 138 includes shroud walls 140 that extend from the base 148 to the mating end 150 of the housing 138. The shroud walls 140 and the front side 154 of the base 148 define a cavity 142 that is open at the mating end 150. For example, the shroud walls 140 define sides of the cavity 142 and the base 148 defines an end or bottom of the cavity 142. The header signal contacts 144 and header ground shields 146 extend from the base 148 into the cavity 142. The receptacle connector 102 is received in the cavity 142 through the mating end 150 during a mating operation. The receptacle housing 120 may engage the shroud walls 140 to guide the receptacle connector 102 into the cavity 142 to mate with the header connector 104.

Figure 2:
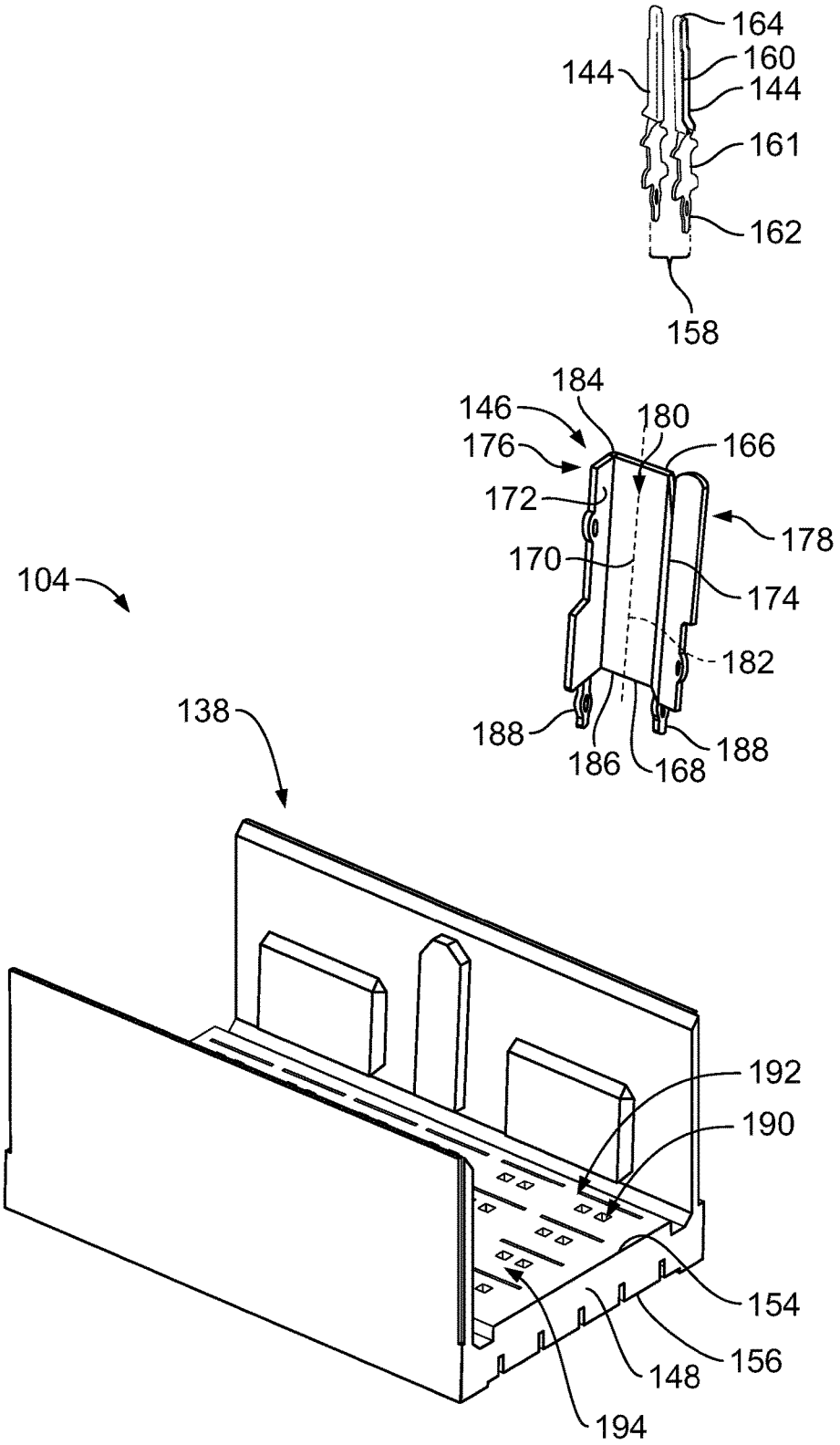
FIG. 2 is an exploded perspective view of the header connector showing a header ground shield according to an embodiment.

FIG. 2 is an exploded perspective view of the header connector 104 according to an embodiment. The header connector 104 includes the header housing 138, multiple header signal contacts 144, and multiple header ground shields 146. As used herein, the header connector 104, the header housing 138, the header signal contacts 144, and the header ground shields 146 may be referred to simply as connector 104, housing 138, signal contacts 144, and header ground shields 146, respectively. The receptacle connector 102 (shown in FIG. 1) and components thereof (for example, the receptacle housing 120) may be referred to as mating connector 102 and mating components (for example, mating housing 120). The illustrated pair 158 of signal contacts 144 and the header ground shield 146 may be representative of other signal contacts 144 and header ground shields 146 of the connector 104 that are not shown in FIG. 2.

The pair 158 of signal contacts 144 may be used to convey differential signals. The signal contacts 144 may extend generally parallel to each other. The signal contacts 144 are composed of one or more conductive metal materials, such as copper, silver, gold, or the like. The signal contacts 144 may be stamped and formed or molded. The signal contacts 144 have a mating segment 160, a contact tail 162, and an intermediate segment 161 between the mating segment 160 and the tail 162. The mating segment 160 extends to a distal end 164 of the signal contact 144 and is configured to engage a corresponding receptacle signal contact 124 (shown in FIG. 5) of the receptacle connector 102 (shown in FIG. 1) when the connectors 102, 104 are mated. The mating segment 160 in the illustrated embodiment is a pin or blade, but may have another shape and/or interface in an alternative embodiment, such as a socket. The contact tails 162 of the signal contacts 144 are configured to terminate to the circuit board 108 (shown in FIG. 1) to electrically connect the signal contacts 144 to the circuit board 108. In the illustrated embodiment, the contact tails 162 are compliant pins, such as eye-of-the-needle pins, that are configured to be through-hole mounted to the circuit board 108. For example, the contact tails 162 may be received in corresponding electrical vias or through-holes (not shown) defined in the circuit board 108. In another embodiment, the contact tails 162 may be solder tails configured to be surface-mounted to the circuit board 108, or the like.

The header ground shield 146 extends between a mating end 166 and a terminating end 168. In the illustrated embodiment, the header ground shield 146 has a main panel 170, a first side panel 172 and a second side panel 174 at opposite first and second sides 176, 178 of the main panel 170. The main panel 170, the first side panel 172, and the second side panel 174 define a shield pocket 180 configured to receive at least one signal contact 144, such as a corresponding pair 158 of the signal contacts 144 to provide electrical shielding for the signal contacts 144. The header ground shield 146 extends longitudinally along a header ground shield axis 182 between a front edge 184 and a rear edge 186.

The main panel 170 may be generally planar and is configured to extend along both signal contacts 144. In the illustrated embodiment, the first and second side panels 172, 174 extend in a common direction from the main panel 170 to form the shield pocket 180 that receives the signal contacts 144. The header ground shield 146 may have a generally C-shaped cross-section defined by a plane that intersects the main panel 170 and the two side panels 172, 174. In the illustrated embodiment, the first side panel 172 and the second side panel 174 are oriented non-parallel to each other, but are flared outward away from each other; however, other orientations are possible in alternative embodiments, such as one or both side panels 172, 174 being perpendicular to the main panel 170. The side panels 172, 174 may be bent at angles relative to the main panel 170; however, alternatively, the main panel 170 and/or the side panels 172, 174 may be at least partially curved.

The header ground shield 146 may be stamped and formed from a sheet of metal. For example, the main panel 170 may be formed integral to the side panels 172, 174 such that the side panels 172 are bent out of plane from the main panel 170. Optionally, the side panel 172 and/or the side panel 174 may include multiple walls bent relative to each other to form the respective side panel 172 or 174.

The header ground shield 146 includes contact tails 188 extending from the rear edges 186 of the side panels 172, 174; however, the main panel 170 may include contact tails 188 in other embodiments. The contact tails 188, in the illustrated embodiment, are compliant pins configured to be through-hole mounted to the circuit board 108 (shown in FIG. 1) to provide an electrical grounding path between the header ground shield 146 and the circuit board 108. In an alternative embodiment, instead of compliant pins, the contact tails 188 may be solder tails configured to be surface-mounted to the circuit board 108 or another type of mounting interface.

The base 148 of the housing 138 defines signal openings 190 extending through the base 148. The signal openings 190 are sized and shaped to each receive and hold a signal contact 144 therein. In the illustrated embodiment, the signal openings 190 are arranged in pairs to receive the pairs 158 of signal contacts 144. The base 148 also includes ground slots 192 extending through the base 148 that are configured to receive and hold the header ground shields 146. The signal openings 190 and the ground slots 192 extend fully through the base 148 between the front and rear sides 154, 156. The signal openings 190 and the ground slots 192 are arranged in an array of multiple columns and rows along the base 148. The housing 138, or at least the base 148 thereof, is composed of a dielectric material, such as one or more plastics, conductive polymers, or the like. The base 148 includes divider walls 194 that define and extend between the signal openings 190 and the ground slots 192. The divider walls 194 electrically insulate the signal contacts 144 from other signal contacts 144 and the header ground shields 146. The signal openings 190 and the ground slots 192 are sized and shaped to accommodate the signal contacts 144 and the header ground shields 146, respectively, and to hold the signal contacts 144 and the header ground shields 146 in fixed positions. Optionally, the ground slots 192 may be continuous along the columns for receiving multiple header ground shields 146. When the header ground shield 146 is received in a corresponding ground slot 192, the header ground shield 146 may engage the divider walls 194 such that the header ground shields 146 are held in the base 148 by a frictional fit.

Figure 3:
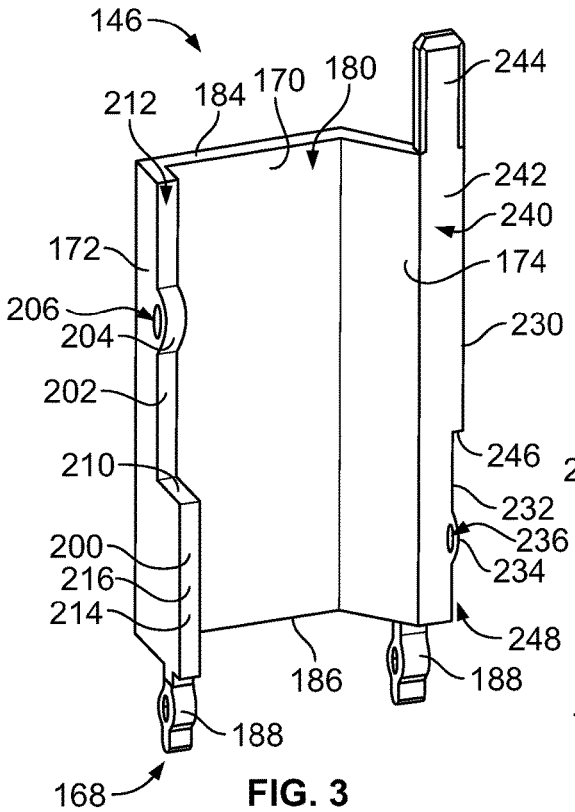
FIG. 3 is a perspective view of the header ground shield in accordance with an exemplary embodiment.
Figure 4:
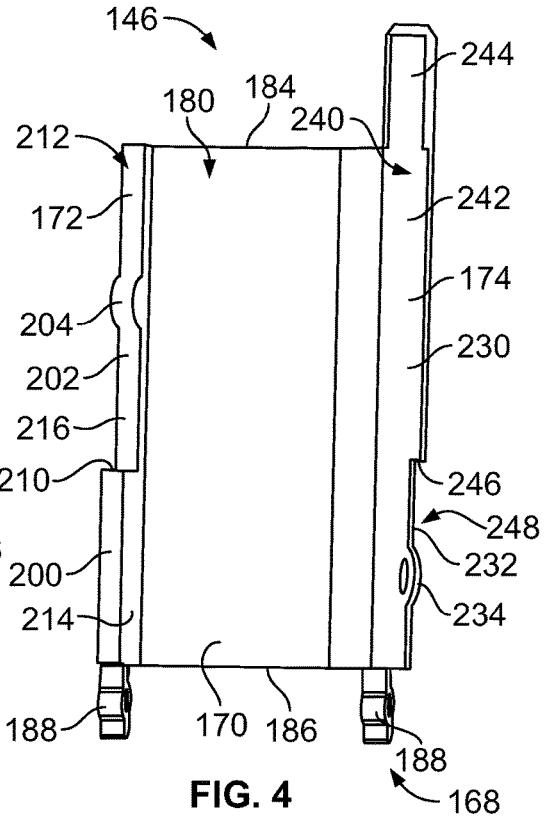
FIG. 4 is a side view of the header ground shield in accordance with an exemplary embodiment.

FIG. 3 is a perspective view of the header ground shield 146 in accordance with an exemplary embodiment. FIG. 4 is a side view of the header ground shield 146 in accordance with an exemplary embodiment. FIGS. 3 and 4 show the main panel 170 and the first and second side panels 172, 174 forming the shield pocket 180. The shield pocket 180 extends between the front edge 184 and the rear edge 186.

The rear edge 186 is configured to abut against the circuit board 108 (shown in FIG. 1), which may have a ground plane at the mating surface thereof to provide electrical shielding from the rear edge 186 through the circuit board 108. The front edge 184 is configured to be received in the receptacle connector 102 and may terminate at a shield structure of the receptacle connector 102, which extends the shielding for the signal lines through the receptacle connector 102. As such, the electrical shielding may be continuous between the receptacle connector 102 and the circuit board 108 through the header connector 104 (shown in FIG. 1) by the header ground shield 146 providing continuous shielding between the circuit board 108 and the receptacle connector 102.

In an exemplary embodiment, the header ground shield 146 is configured to be electrically connected to an adjacent header ground shield(s) 146 (see, for example, FIG. 5) by direct physical contact with the adjacent header ground shield(s) 146 to provide a continuous shield structure through the header connector 104. In an exemplary embodiment, the header ground shield 146 is configured to at least partially overlap a corresponding portion of the adjacent header ground shield(s) 146 to provide a continuous shield structure through the header connector 104. In an exemplary embodiment, the header ground shield 146 is configured to be at least partially overlapped by a corresponding portion of the adjacent header ground shield(s) 146 to provide a continuous shield structure through the header connector 104.

In an exemplary embodiment, the first side panel 172 of the header ground shield 146 includes a first overlapping segment 200 configured overlap a portion of the adjacent header ground shield 146 and a first engagement segment 202 configured to be overlapped by and directly engage a portion of the adjacent header ground shield 146. In an exemplary embodiment, the first engagement segment 202 includes a first mating beam 204 extending therefrom configured to engage the adjacent header ground shield 146. In other various embodiments, the first overlapping segment 200 may additionally or alternatively include one or more of the mating beams 204.

The mating beam 204 is a protrusion or protuberance standing proud of (for example, extending from) adjacent sections of the first side panel 172 to ensure engagement with the adjacent header ground shield 146. In the illustrated embodiment, the mating beam 204 extends outward, such as away from the main panel 170 at an angle therefrom, such as generally perpendicular to the main panel 170; however, the mating beam 204 may extend in other directions, such as sideways from the first side panel 172. Optionally, the mating beam 204 may be deflectable. For example, in the illustrated embodiment, the mating beam 204 is a compliant beam that is deflectable and configured to be elastically deformed when engaging the adjacent header ground shield 146. In the illustrated embodiment, the mating beam 204 is supported at both ends and includes an opening 206 that allows the mating beam 204 to deflect inward when engaging the adjacent header ground shield 146. Other types of mating beams 204 may be provided in alternative embodiments, such as a cantilevered spring beam. In other various embodiments, the mating beam 204 may be non-deflectable. For example, the mating beam 204 may be a tab or bump extending from the first side panel 172 configured to interfere with and press against the adjacent header ground shield 146 when the header connector 104 is assembled.

In the illustrated embodiment, the first overlapping segment 200 extends beyond (for example, further outward from) the first engagement segment 202. As such, when the first engagement segment 202 abuts against the adjacent header ground shield 146, the first overlapping segment 200 is configured to overlap a portion of the adjacent header ground shield 146. In an exemplary embodiment, the first side panel 172 includes a shelf 210 and a cutout 212 forward of the shelf 210 (for example, toward the front edge 184). The first side panel 172 includes a lateral separating wall 214 extending from the first side panel 172, such as at an outer edge 216 of the first side panel 172. The shelf 210 is provided at the front of the lateral separating wall 214. The cutout 212 is forward of the lateral separating wall 214 (for example, toward the front edge 184). In the illustrated embodiment, the lateral separating wall 214 defines the first overlapping segment 200 because the lateral separating wall 214 is configured to extend beyond or overlap a portion of the adjacent header ground shield 146. The outer edge 216 at the first engagement segment 202 is stepped inward toward the main panel 170. For example, the outer edge 216 at the first engagement segment 202 is at a first depth from the main panel 170 and the outer edge 216 at the first overlapping segment 200 is at a second depth from the main panel 170 greater than the first depth. In an exemplary embodiment, the contact tail 188 extends from the lateral separating wall 214; however, the contact tail 188 may be provided at other locations in alternative embodiments.

In the illustrated embodiment, the first overlapping segment 200 is outward relative to the first engagement segment 202 further from the main panel 170, thus defining the shelf 210. The first overlapping segment 200 is behind the first engagement segment 202. For example, the lateral separating wall 214, which defines the first overlapping segment 200, is positioned rearward of the first engagement segment 202 (for example, toward the rear edge 186). The first overlapping segment 200 extends between the rear edge 186 and the shelf 210. The first engagement segment 202 extends between the shelf 210 and the front edge 184. The first engagement segment 202 is positioned forward of the first overlapping segment 200. The first engagement segment 202 is positioned inward of the first overlapping segment 200, closer to the main panel 170.

In an exemplary embodiment, the second side panel 174 of the header ground shield 146 includes a second overlapping segment 230 configured to overlap a portion of the adjacent header ground shield 146 and a second engagement segment 232 configured to be overlapped by and directly engage a portion of the adjacent header ground shield 146. In an exemplary embodiment, the second engagement segment 232 includes a second mating beam 234 extending therefrom configured to engage the adjacent header ground shield 146. In other various embodiments, the second overlapping segment 230 may additionally or alternatively include one or more of the mating beams 234. In an exemplary embodiment, the contact tail 188 extends from the second side panel 174; however, the contact tail 188 may be provided at other locations in alternative embodiments.

The mating beam 234 is a protrusion or protuberance standing proud of (for example, extending from) adjacent sections of the second side panel 174 to ensure engagement with the adjacent header ground shield 146. In the illustrated embodiment, the mating beam 234 extends sideways, such as generally parallel to the main panel 170 and away from the shield pocket 180; however, the mating beam 204 may extend in other directions, such as outward away from the second side panel 174. Optionally, the mating beam 234 may be deflectable. For example, in the illustrated embodiment, the mating beam 234 is a compliant beam that is deflectable and configured to be elastically deformed when engaging the adjacent header ground shield 146. In the illustrated embodiment, the mating beam 234 is supported at both ends and includes an opening 236 that allows the mating beam 234 to deflect inward when engaging the adjacent header ground shield 146. Other types of mating beams 234 may be provided in alternative embodiments, such as a cantilevered spring beam. In other various embodiments, the mating beam 234 may be non-deflectable. For example, the mating beam 234 may be a tab or bump extending from the second side panel 174 configured to interfere with and press against the adjacent header ground shield 146 when the header connector 104 is assembled.

In an exemplary embodiment, the second side panel 174 includes a grounding beam 240 having a mating surface 242 configured to engage in mate with the receptacle ground contact 126 (shown in FIG. 8) of the receptacle connector 102 when the header connector 104 is mated with the receptacle connector 102. In the illustrated embodiment, the grounding beam 240 is bent or angled relative to the main section of the second side panel 174. For example, the grounding beam 240 may be bent at an angle such that the mating surface 242 is generally parallel to the main panel 170. The mating surface 242 is a planar surface configured for mating engagement with the deflectable receptacle ground contact 126. In an exemplary embodiment, the grounding beam 240 includes a post 244 at the terminating end 168 of the header ground shield 146. The post 244 extends forward of the front edge 184. The post 244 is configured to be plugged into the receptacle connector 102 to make a grounding electrical connection with the receptacle ground contact 126 of the receptacle connector 102 prior to mating of the receptacle signal contacts 124, 144. In an exemplary embodiment, the grounding beam 240 defines at least a portion of the second overlapping segment 230. In an exemplary embodiment, the grounding beam 240 defines at least a portion of the second engagement segment 232.

The second side panel 174 includes a ledge 246 and a cutout 248 rearward of the ledge 246 (for example, toward the rear edge 186). The ledge 246 is provided at the rear of the second overlapping segment 230. The ledge 246 defines the second overlapping segment 230 because the ledge 246 is configured to extend beyond or overlap a portion of the adjacent header ground shield 146. In the illustrated embodiment, the second overlapping segment 230, defined by the ledge 246, extends beyond (for example, further to one side of) the second engagement segment 232. As such, when the second engagement segment 232 abuts against the adjacent header ground shield 146, the ledge 246, and thus the second overlapping segment 230, is configured to overlap a portion of the adjacent header ground shield 146.

In the illustrated embodiment, the second overlapping segment 230 is forward of the second engagement segment 232 (for example, toward the front edge 184). For example, the ledge 246, which defines the second overlapping segment 230, is positioned forward of the cutout 248 and the second engagement segment 232. The second engagement segment 232 extends between the rear edge 186 and the ledge 246. The second overlapping segment 230 extends between the ledge 246 and the front edge 184.

Figure 5:
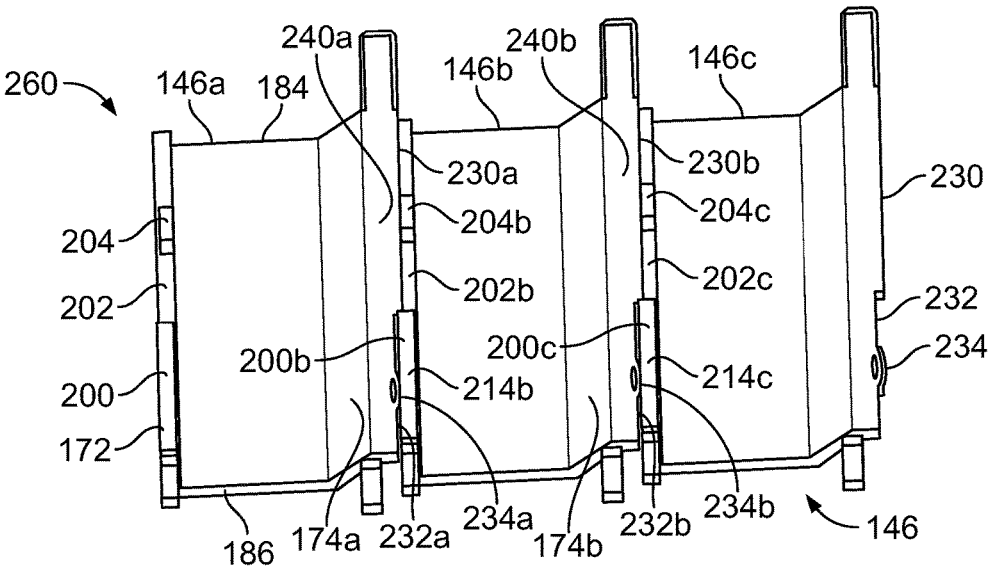
FIG. 5 is a perspective view of a continuous ground structure defined by a plurality of the header ground shields.

FIG. 5 is a perspective view of a continuous ground structure 260 defined by a plurality of header ground shields 146 mechanically and electrically coupled together to form the continuous ground structure 260. In the illustrated embodiment, three header ground shields 146 are illustrated coupled together to form a continuous ground structure 260; however, any number of header ground shields 146 may be ganged together to form the continuous ground structure 260. In an exemplary embodiment, the header ground shields 146 are identical to each other. The overlapping segments 200, 230 are configured overlap portions of the adjacent header ground shield 146. The engagement segments 202, 232 are configured to engage portions of the adjacent header ground shields 146 to mechanically and electrically connect the header ground shields 146.

When the header ground shields 146 are loaded into the housing 138 of the header connector 104 (both shown in FIG. 1), the header ground shields 146 may be tightly held together such that the mating beams 204, 234 may be deflected against the adjacent header ground shields 146 to maintain an electrical connection therebetween. The header ground shields 146 have multiple points of contact with adjacent header ground shields 146 to improve continuity of the ground structure 260. In an exemplary embodiment, the header ground shields 146 have multiple points of contact at different axial locations between the front edge 184 and the rear edge 186. For example, the header ground shields 146 may have a point of contact in the area of the base 148 (shown in FIG. 1), such as near the rear edge 186, and in the mating area, such as near the front edge 184. The header ground shields 146 provide electrical crosstalk isolation through the ground structure 260.

In the illustrated embodiment, the continuous ground structure 260 includes a first header ground shield 146*a*, a second header ground shield 146*b* and a third header ground shield 146*c* (the a, b and c identifiers are used to identify the components of the first, second and third header ground shields, respectively). When part of a larger ground structure 260 having more than three header ground shields 146 of the first header ground shield 146*a* may represent an end header ground shield or may be an interior header ground shield depending on the location of the other header ground shields 146 in the ground structure 260. Similarly, when part of a larger ground structure 260 having more than three header ground shields 146 of the third header ground shield 146*c* may represent an end header ground shield or may be an interior header ground shield depending on the location of the other header ground shields 146 in the ground structure 260. The header ground shields 146 are arranged side-by-side such that the first side panels 172 of various header ground shields 146 engage the second side panels 174 of adjacent header ground shields 146 and such that the second side panels 174 of various header ground shields 146 engage the first side panels 172 of adjacent header ground shields 146.

When assembled, the first overlapping segment 200*b* of the second header ground shield 146*b* overlaps and engages the second engagement segment 232*a* of the first header ground shield 146*a* and the second overlapping segment 230*a* of the first header ground shield 146*a* overlaps and engages the first engagement segment 202*b* of the second header ground shield 146*b*. The second overlapping segment 230*b* of the second header ground shield 146*b* overlaps and engages the first engagement segment 202*c* of the third header ground shield 146*c* and the first overlapping segment 200*c* of the third header ground shield 146*c* overlaps and engages the second engagement segment 232*b* of the second header ground shield 146*b*.

When assembled, the first mating beam 204*b* on the first engagement segment 202*b* of the second header ground shield 146*b* engages the grounding beam 240*a* defining the second overlapping segment 230*a* of the first header ground shield 146*a*. Similarly, the first mating beam 204*c* on the first engagement segment 202*c* of the third header ground shield

146*c* engages the grounding beam 240*b* defining the second overlapping segment 230*b* of the second header ground shield 146*b*.

When assembled, the second mating beam 234*a* on the second engagement segment 232*a* of the first header ground shield 146*a* engages the lateral separating wall 214*b* defining the first overlapping segment 200*b* of the second header ground shield 146*b*. The lateral separating wall 214*b* of the second header ground shield 146*b* extends beyond the grounding beam 240*a* of the first header ground shield 146*a* such that the first overlapping segment 200*b* of the second header ground shield 146*b* overlaps a portion of the second side panel 174*a* of the first header ground shield 146*a*. Similarly, the second mating beam 234*b* on the second engagement segment 232*b* of the second header ground shield 146*b* engages the lateral separating wall 214*c* defining the first overlapping segment 200*c* of the third header ground shield 146*c*. The lateral separating wall 214*c* of the third header ground shield 146*c* extends beyond the grounding beam 240*b* of the second header ground shield 146*b* such that the first overlapping segment 200*c* of the third header ground shield 146*c* overlaps a portion of the second side panel 174*b* of the second header ground shield 146*b*.

Figure 6:
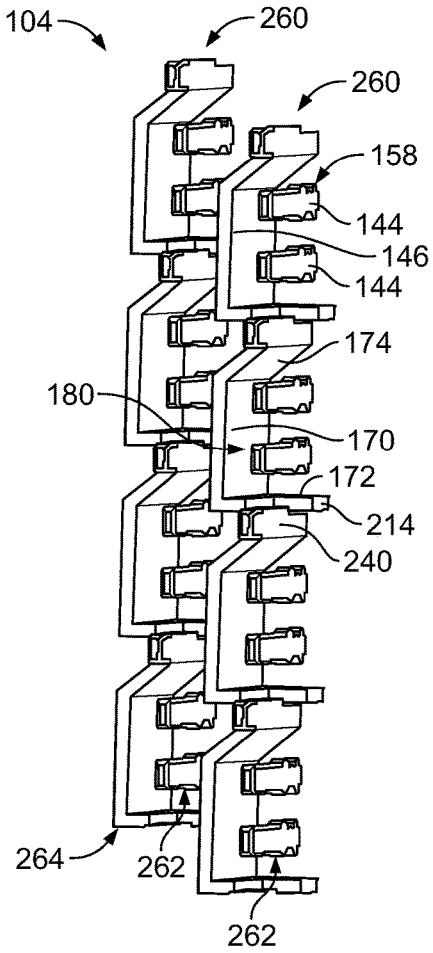
FIG. 6 is a perspective view of a portion of the header connector showing columns of signal contacts and corresponding ground structures.
Figure 7:
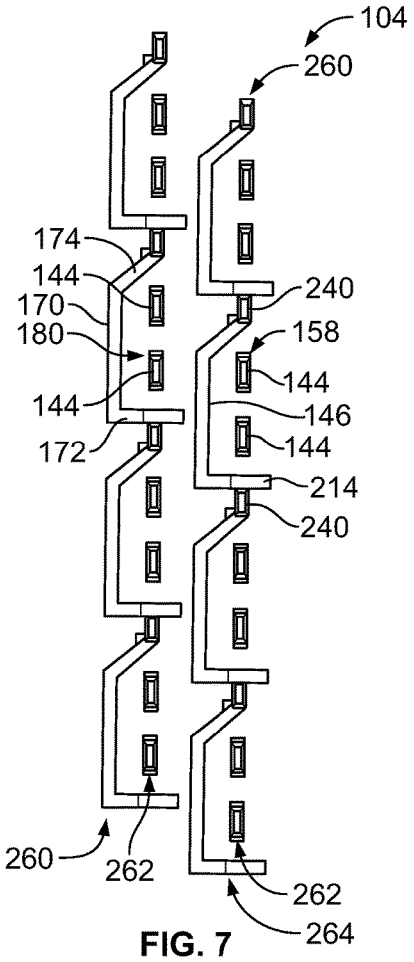
FIG. 7 is a front view of a portion of the header connector showing the columns of signal contacts and corresponding ground structures.

FIG. 6 is a perspective view of a portion of the header connector 104 showing columns 262 of signal contacts 144 and corresponding ground structures 260 defining shield columns 264 for the signal contacts 144. FIG. 7 is a front view of a portion of the header connector 104 showing the columns 262 of signal contacts 144 and corresponding ground structures 260 defining the shield columns 264 for the signal contacts 144. While only two columns 262 of signal contacts 144 and two shield columns 264 are illustrated in FIGS. 6 and 7, it is realized that the header connector 104 may include any number of columns 262 of signal contacts 144 and corresponding shield columns 264.

Each shield column 264 provides electrical shielding for the corresponding column 262 of signal contacts 144. In the illustrated embodiment, the signal contacts 144 are arranged in the pairs 158 with each header ground shield 146 providing electrical shielding for the corresponding pair 158 of signal contacts 144. Each shield pocket 180 receives a corresponding pair 158 of signal contacts 144. Each of the header ground shields 146 in the shield column 264 are electrically connected within the corresponding continuous ground structure 260. The main panels 170 provide electrical shielding between adjacent columns 262 of signal contacts 144. The first and second side panels 172, 174 provide electrical shielding between adjacent pairs 158 of signal contacts 144 within the same column 262. The grounding beams 240 may provide electrical shielding between the pairs 158 of signal contacts 144 in the same column 262.

In an exemplary embodiment, the lateral separating walls 214 of the first side panels 172 extend beyond the corresponding first side panels 172 of the adjacent header ground shields 146 to provide electrical shielding beyond the grounding beams 240. For example, the grounding beams 240 may be arranged in line with the columns 262 of signal contacts 144 while the lateral separating walls 214 extend beyond the columns 262 of signal contacts 144. The main panel 170 and the side panels 172, 174, with the lateral separating wall 214 provide a fully shielded area to isolate the differential pairs of signal contacts 144. Optionally, the lateral separating walls 214 may engage and electrically connect to corresponding header ground shields 146 in the adjacent shield column 264. For example, the lateral separating walls 214 may include mating beams (not shown) configured to engage a portion of one of the header ground shields 146 in the adjacent shield column 264, such as at the main panel 170 of the corresponding header ground shield 146 in the adjacent shield column 264.

Figure 8:
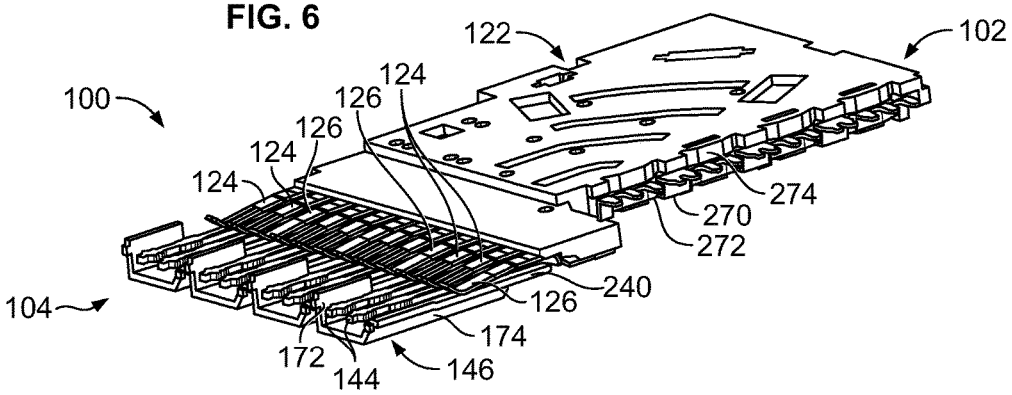
FIG. 8 is a perspective view of a portion of the connector assembly showing a portion of the receptacle connector mated to a portion of the header connector.
Figure 9:
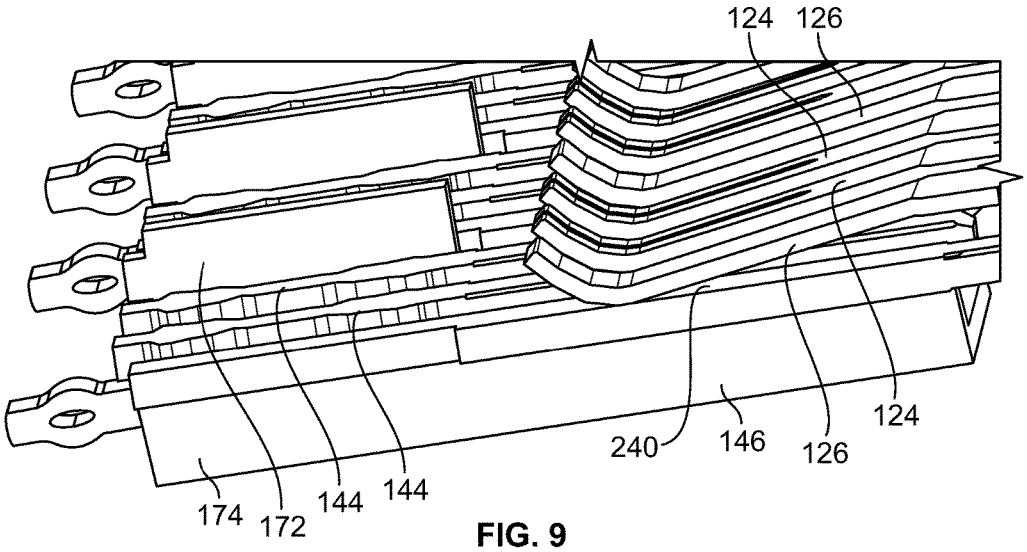
FIG. 9 is an enlarged view of a portion of the connector assembly showing a portion of the receptacle connector mated to a portion of the header connector.

FIG. 8 is a perspective view of a portion of the connector assembly 100 showing a portion of the receptacle connector 102 mated to a portion of the header connector 104. FIG. 9 is an enlarged view of a portion of the connector assembly 100 showing a portion of the receptacle connector 102 mated to a portion of the header connector 104. FIG. 8 illustrates one of the contact modules 122 of the receptacle connector 102 mated to the corresponding header signal contacts 144 and header ground shields 146. FIG. 9 illustrates the header signal contacts 144 and the header ground shields 146 electrically connected to corresponding receptacle signal contacts 124 and receptacle ground contacts 126 of the receptacle connector 102.

The contact module 122 includes the receptacle signal contacts 124 and the receptacle ground contacts 126. The receptacle ground contacts 126 may be part of a ground shield 270 coupled to a side 272 of a dielectric frame 274 used to hold the receptacle signal contacts 124. In various embodiments, the dielectric frame 274 is an overmolded body overmolded over the receptacle signal contacts 124. In various embodiments, the dielectric frame 274 may be overmolded over the receptacle ground contacts 126 in addition to the receptacle signal contacts 124; however, as in the illustrated embodiment, the receptacle ground contacts 126 may be part of the ground shield 270 coupled to the side 272 of the dielectric frame 274 after the dielectric frame 274 is formed around the receptacle signal contacts 124. Other types of contact modules 122 may be provided in alternative embodiments. The receptacle signal contacts 124 are arranged in pairs configured to engage corresponding header signal contacts 144. The receptacle ground contacts 126 are arranged between the pairs of receptacle signal contacts 124 and are configured to engage the header ground shields 146. For example, the receptacle ground contacts 126 may be mated to corresponding grounding beams 240 of the second side panels 174 of each corresponding header ground shield 146. The receptacle ground contacts 126 may additionally or alternatively be mated with corresponding portions of the first side panels 172 of the header ground shields 146.

Figure 10:
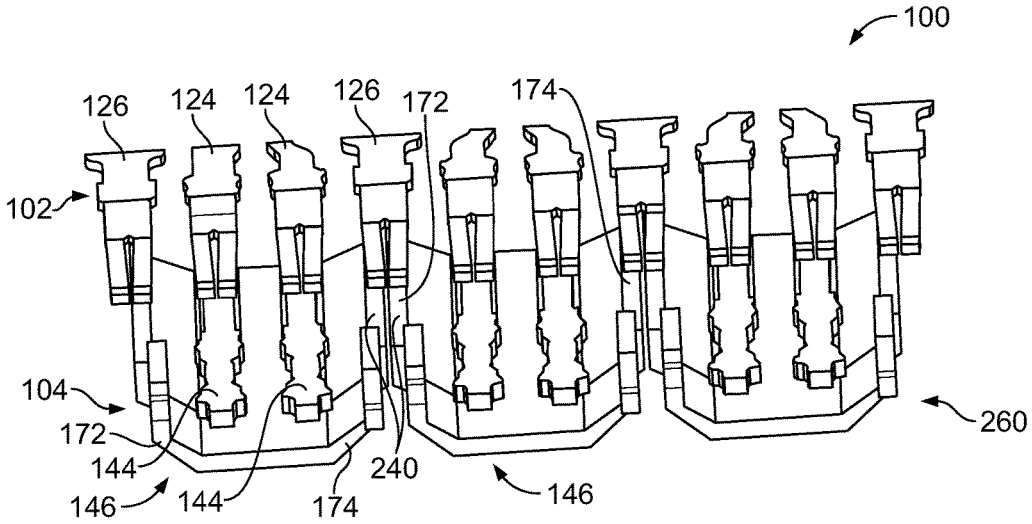
FIG. 10 is a perspective view of a portion of the connector assembly in accordance with an exemplary embodiment showing a portion of the receptacle connector mated to a portion of the header connector.

FIG. 10 is a perspective view of a portion of the connector assembly 100 in accordance with an exemplary embodiment showing a portion of the receptacle connector 102 mated to a portion of the header connector 104. The illustrated embodiment shown in FIG. 10 is similar to the illustrated embodiment shown in FIG. 9; however, the receptacle ground contacts 126 and the receptacle signal contacts 124 are shaped differently, wherein mating ends of the receptacle ground contacts 126 are bifurcated rather than being a single mating beam. Additionally, the illustrated embodiment shown in FIG. 10 shows the header ground shields 146 shaped differently than the illustrated embodiment shown in FIG. 9. For example, in the illustrated embodiment shown in FIG. 10, the header ground shields 146 are symmetrical about the signal contacts 144 wherein the first side panels 172 are mirrored versions of the second side panels 174. Each of the side panels 172, 174 include a corresponding grounding beam 240. The receptacle ground contact 126 straddles over both adjacent side panels 172, 174 of the adjacent header ground shields 146. The adjacent side panels 172, 174 overlap each other and engage each other to form the continuous ground structure 260.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A header connector comprising:

a housing including a base having a front side and an opposite rear side;

signal contacts held in the base, each signal contact having a mating segment extending forward of the front side of the base; and header ground shields held in the base and extending forward of the front side of the base, each header ground shield having a main panel, a first side panel extending from a first side of the main panel and a second side panel extending from a second side of the main panel, wherein the main panel, the first side panel and the second side panel define a shield pocket receiving at least one corresponding signal contact to provide electrical shielding for the at least one corresponding signal contact, the first side panel including a first overlapping segment and a first engagement segment, the second side panel including a second overlapping segment and a second engagement segment, wherein the header ground shields are received in the base in shield columns, corresponding header ground shields in the same shield column engaging adjacent header ground shields such that the first overlapping segments overlap second engagement segments of the adjacent header ground shields and such that the second overlapping segments overlap first engagement segments of the adjacent header ground shields wherein the second side panel extends from the main panel to an outer edge at a first depth from the main panel, the first side panel including a lateral separating wall extending from the first side panel to a second depth from the main panel greater than the first depth.

2. The header connector of claim 1, wherein each header ground shield is identically formed.

3. The header connector of claim 1, wherein the first overlapping segment is one of forward or behind the corresponding second engagement segment of the adjacent header ground shield.

4. The header connector of claim 1, wherein the second overlapping segment is one of forward or behind the corresponding first engagement segment of the adjacent header ground shield.

5. The header connector of claim 1, wherein one of the first overlapping segment or the first engagement segment is between the base of the housing and the corresponding second engagement segment or the second overlapping segment of the adjacent header ground shield.

6. The header connector of claim 1, wherein one of the second overlapping segment or the second engagement segment is between the base of the housing and the corresponding first engagement segment or the first overlapping segment of the adjacent header ground shield.

7. The header connector of claim 1, wherein at least one of the first overlapping segment or the first engagement segment includes a mating beam extending therefrom directly engaging the adjacent header ground shield.

8. The header connector of claim 7, wherein the mating beam is deflectable and elastically deformed when engaging the adjacent header ground shield.

9. The header connector of claim 7, wherein the mating beam extends in a direction parallel to the main panel.

10. The header connector of claim 7, wherein the mating beam extends in a direction perpendicular to the main panel.

11. The header connector of claim 1, wherein the first side panel includes a shelf and a cutout forward of the shelf, the second side panel includes a ledge defining the second overlapping segment, the ledge being received in the cutout and overlapping the shelf forward of the shelf.

12. The header connector of claim 1, wherein the second side panel includes a grounding beam having a mating surface parallel to the main panel, the grounding beam configured to engage a ground contact of a receptacle connector mated with the header connector, the grounding beam defining the second overlapping segment.

13. The header connector of claim 12, wherein the grounding beam includes a post extending forward of the main panel and the second side panel.

14. The header connector of claim 1, wherein the first side panel extends at a first angle from the first side of the main panel and the second side panel extends at a second angle from the second side of the main panel, the first angle being different than the second angle and the first side panel being non-parallel to the second side panel.

15. The header connector of claim 1, wherein the first side panel extends to an outer edge defining a mating edge of the first side panel configured to be mated with a corresponding mating ground contact and wherein the second side panel extends to an outer edge defining a mating edge of the first side panel configured to be mated with a corresponding mating ground contact, the mating segments of the signal contacts having mating surfaces configured to be mated with a corresponding mating signal contact, the mating edges of the first and second side panels being coplanar with the mating surfaces of the signal contacts.

16. A header connector comprising:

a housing including a base having a front side and an opposite rear side;

signal contacts held in the base, each signal contact having a mating segment extending forward of the front side of the base; and header ground shields held in the base and extending forward of the front side of the base, each header ground shield having a main panel, a first side panel extending at a first angle from a first side of the main panel and a second side panel extending at a second angle from a second side of the main panel, the first angle being different than the second angle and the first side panel being non-parallel to the second side panel, wherein the main panel, the first side panel and the second side panel define a shield pocket receiving at least one corresponding signal contact to provide electrical shielding for the at least one corresponding signal contact, the first side panel including a first overlapping segment configured to engage an adjacent header ground shield and a first engagement segment configured to engage an adjacent header ground shield, the second side panel including a second overlapping segment configured to engage an adjacent header ground shield and a second engagement segment configured to engage an adjacent header ground shield;

wherein at least one of the first overlapping segment and the first engagement segment includes a first mating beam extending therefrom configured to engage the adjacent header ground shield; and wherein at least one of the second overlapping segment and the second engagement segment includes a second mating beam extending therefrom configured to engage the adjacent header ground shield.

17. The header connector of claim 16, wherein the second side panel extends from the main panel to an outer edge at a first depth from the main panel, the first side panel including a lateral separating wall extending from the first side panel to a second depth from the main panel greater than the first depth.

18. The header connector of claim 16, wherein the first and second mating beams are deflectable and elastically deformed when engaging the adjacent header ground shield.

19. The header connector of claim 16, wherein each header ground shield is identically formed.

20. The header connector of claim 16, wherein one of the first overlapping segment or the first engagement segment is between the base of the housing and the corresponding second engagement segment or the second overlapping segment of the adjacent header ground shield, and wherein one of the second overlapping segment or the second engagement segment is between the base of the housing and the corresponding first engagement segment or the first overlapping segment of the adjacent header ground shield.

21. The header connector of claim 16, wherein the first side panel includes a shelf and a cutout forward of the shelf, the second side panel includes a ledge defining the second overlapping segment, the ledge being received in the cutout and overlapping the shelf forward of the shelf.

22. The header connector of claim 16, wherein the second side panel includes a grounding beam having a mating surface parallel to the main panel, the grounding beam configured to engage a ground contact of a receptacle connector mated with the header connector, the grounding beam defining the second overlapping segment.

23. A header connector comprising:

a housing including a base having a front side and an opposite rear side;

signal contacts held in the base, each signal contact having a mating segment extending forward of the front side of the base, the mating segments of the signal contacts having mating surfaces configured to be mated with corresponding mating signal contacts of a receptacle connector; and header ground shields held in the base in shield columns with the header ground shields in each column engaging each other to provide a continuous electrical shield in the shield column, the header ground shields extending forward of the front side of the base to provide electrical shielding for the mating segments of the corresponding signal contacts, the shield column including a first header ground shield, a second header ground shield and a third header ground shield with the second header ground shield arranged between the first and third header ground shields;

the first header ground shield including a main panel, a first side panel extending from a first side of the main panel and a second side panel extending from a second side of the main panel, wherein the main panel, the first side panel and the second side panel define a shield pocket receiving at least one corresponding signal contact to provide electrical shielding for the at least one corresponding signal contact, the first side panel including a first overlapping segment and a first engagement segment, the second side panel including a second overlapping segment and a second engagement segment, wherein the first and second side panels of the first header ground shield have outer edges defining mating edges configured to be mated with corresponding mating ground contacts of a receptacle connector;

the second header ground shield including a main panel, a first side panel extending from a first side of the main panel and a second side panel extending from a second side of the main panel, wherein the main panel, the first side panel and the second side panel define a shield pocket receiving at least one corresponding signal contact to provide electrical shielding for the at least one corresponding signal contact, the first side panel including a first overlapping segment and a first engagement segment, the second side panel including a second overlapping segment and a second engagement segment, wherein the first and second side panels of the second header ground shield have outer edges defining mating edges configured to be mated with corresponding mating ground contacts of a receptacle connector;

the third header ground shield including a main panel, a first side panel extending from a first side of the main panel and a second side panel extending from a second side of the main panel, wherein the main panel, the first side panel and the second side panel define a shield pocket receiving at least one corresponding signal contact to provide electrical shielding for the at least one corresponding signal contact, the first side panel including a first overlapping segment and a first engagement segment, the second side panel including a second overlapping segment and a second engagement segment, wherein the first and second side panels of the third header ground shield have outer edges defining mating edges configured to be mated with corresponding mating ground contacts of a receptacle connector;

wherein the mating edges of the first and second side panels of the header ground shields in each column are coplanar with the mating surfaces of the corresponding signal contacts;

wherein the first overlapping segment of the second header ground shield overlaps and engages the second engagement segment of the first header ground shield and the second overlapping segment of the first header ground shield overlaps and engages the first engagement segment of the second header ground shield; and wherein the second overlapping segment of the second header ground shield overlaps and engages the first engagement segment of the third header ground shield and the first overlapping segment of the third header ground shield overlaps and engages the second engagement segment of the second header ground shield.

* * * * *